US005519471A

United States Patent [19]

Nishimura et al.

[11] Patent Number: 5,519,471

[45] Date of Patent: May 21, 1996

[54] DEVELOPER CARRYING MEMBER UTILIZING OSCILLATING BIAS HAVING CONSTANT-VOLTAGE-DC COMPONENT AND CONSTANT-CURRENT AC COMPONENT, AND DEVELOPING APPARATUS AND IMAGE FORMING APPARATUS USING SAME

[75] Inventors: Katsuhiko Nishimura, Yokohama; Kimio Nakahata, Kawasaki; Koichi Tanigawa, Tokyo; Toshio Miyamoto, Yokohama; Makoto Takeuchi, Tokyo, all of Japan

[73] Assignee: Canon Kabushiki Kaisha, Tokyo, Japan

[21] Appl. No.: 165,942

[22] Filed: Dec. 14, 1993

[30] Foreign Application Priority Data

Dec. 16, 1992 [JP] Japan ..... 4-336169

[51] Int. Cl.[6] ..... G03G 21/00

[52] U.S. Cl. ..... 355/246; 118/651; 355/265

[58] Field of Search ..... 355/208, 246, 355/245, 265, 251, 253, 210; 118/647, 651

[56] References Cited

U.S. PATENT DOCUMENTS

| | | | |
|---|---|---|---|
| 4,292,387 | 9/1981 | Kanbe et al. | 118/657 X |
| 4,370,049 | 1/1983 | Kuge et al. | 355/251 |
| 4,380,966 | 4/1983 | Isaka et al. | 118/651 |
| 4,385,476 | 5/1983 | Slager | 52/720 |
| 4,385,829 | 5/1983 | Nakahata et al. | 355/253 |
| 4,557,582 | 12/1985 | Kan et al. | 355/251 X |
| 4,600,295 | 7/1986 | Suzuki | 355/246 |
| 4,669,852 | 6/1987 | Tajima et al. | 355/253 |
| 4,766,468 | 8/1988 | Hosono et al. | 355/261 X |
| 4,958,187 | 9/1990 | Tsuchiya et al. | 355/202 |
| 4,989,044 | 1/1991 | Nishimura et al. | 355/251 |
| 5,084,733 | 1/1992 | Katoh et al. | 355/251 |
| 5,177,537 | 1/1993 | Okano et al. | 355/259 |
| 5,185,496 | 2/1993 | Nishimura et al. | 118/658 |
| 5,187,535 | 2/1993 | Tajima | 118/647 X |
| 5,202,729 | 4/1993 | Miyamoto et al. | 355/251 |
| 5,202,731 | 4/1993 | Tanikawa et al. | 355/246 X |
| 5,270,783 | 12/1993 | Bisaiji et al. | 355/246 |
| 5,309,207 | 5/1994 | Omori | 355/246 |
| 5,365,316 | 11/1994 | Motoyama et al. | 355/246 X |

*Primary Examiner*—A. T. Grimley
*Assistant Examiner*—Shuk Y. Lee
*Attorney, Agent, or Firm*—Fitzpatrick, Cella, Harper & Scinto

[57] ABSTRACT

A developing apparatus includes an image bearing member for bearing an electrostatic image, a developer carrying member, opposed to the image bearing member to form a developing zone therebetween, for carrying a developer to the developing zone to develop an electrostatic latent image on the image bearing member, and oscillating bias means for applying an oscillating bias to the developer carrying member, wherein the oscillating bias includes a constant-current-controlled AC component and a constant-voltage-controlled DC component.

15 Claims, 3 Drawing Sheets

DEVELOPER CARRYING MEMBER UTILIZING OSCILLATING BIAS HAVING CONSTANT-VOLTAGE-DC COMPONENT AND CONSTANT-CURRENT AC COMPONENT, AND DEVELOPING APPARATUS AND IMAGE FORMING APPARATUS USING SAME

FIELD OF THE INVENTION AND RELATED ART

The present invention relates to a developing apparatus in which an oscillating bias voltage is applied to a developer carrying member which carries a developer and transfers the developer onto an electrostatic latent image in a developing zone, and an image forming apparatus comprising the developing apparatus.

It is known to apply to a developer carrying member such as a developing sleeve or developing roller, an oscillating bias voltage in which an AC voltage component having a waveform such as a sine wave, a rectangular wave, or a triangular wave is superposed on a DC voltage component (U.S. Pat. Nos. 4,292,387, 4,395,476, and 4,600,295).

The DC voltage component contributes to the prevention of a foggy image, the improvement of the density of the developed image, the optimization of the line width in line images, and the like, and the AC voltage component contributes to stimulate the activity of the developer in the developing zone, which in turn contributes to the improvement of the density or tone gradation of the developed image, the prevention of the thinning of line drawings, and the like.

Now, in some cases, a gap between the image bearing member and the developer carrying member periodically changes due to eccentricity or misalignment of the image bearing member, the developer carrying member, or a spacer roller for maintaining the gap between those two components.

In such cases, the oscillating electric field generated in the developing zone by the application of the oscillating bias voltage to the developer carrying member periodically changes in accordance with changes in the aforementioned gap; therefore, the activity of the developer in the developing zone changes, resulting in periodic changes in the density or line width of the developed image.

Further, in an exchangeable process cartridge which integrally supports an image bearing member, a developing device, and if necessary, a charger and/or cleaning device, the gap between the image bearing member and the developer carrying member sometimes varies due to differences between the production lines of the process cartridge.

In such cases, the density, or the line width, of the developed image may also be different for each cartridge, due to the same reason mentioned above.

Further, with the accumulation of the operating time, the spacer roller or a portion of the image bearing member at which the spacer roller is in contact with the image bearing member, gradually wears out. Also, in this case, the gap between the image bearing member and the developer carrying member gradually changes; therefore, the density or the line width of the developed image changes.

SUMMARY OF THE INVENTION

Accordingly, a primary object of the present invention is to provide a developing apparatus capable of applying an oscillating bias voltage to a developer carrying member, in which, even when a gap between a developer carrying member and an image bearing member changes, changes in the density or the line width of the developed image can be suppressed.

Another object of the present invention is to provide an image forming apparatus comprising an exchangeable process cartridge comprising at least an image bearing member and a developing device, wherein even when a process cartridge in which the gap between the image bearing member and developer carrying member deviates slightly from a reference value is installed, the changes in the density and line width of the developed image can be suppressed.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
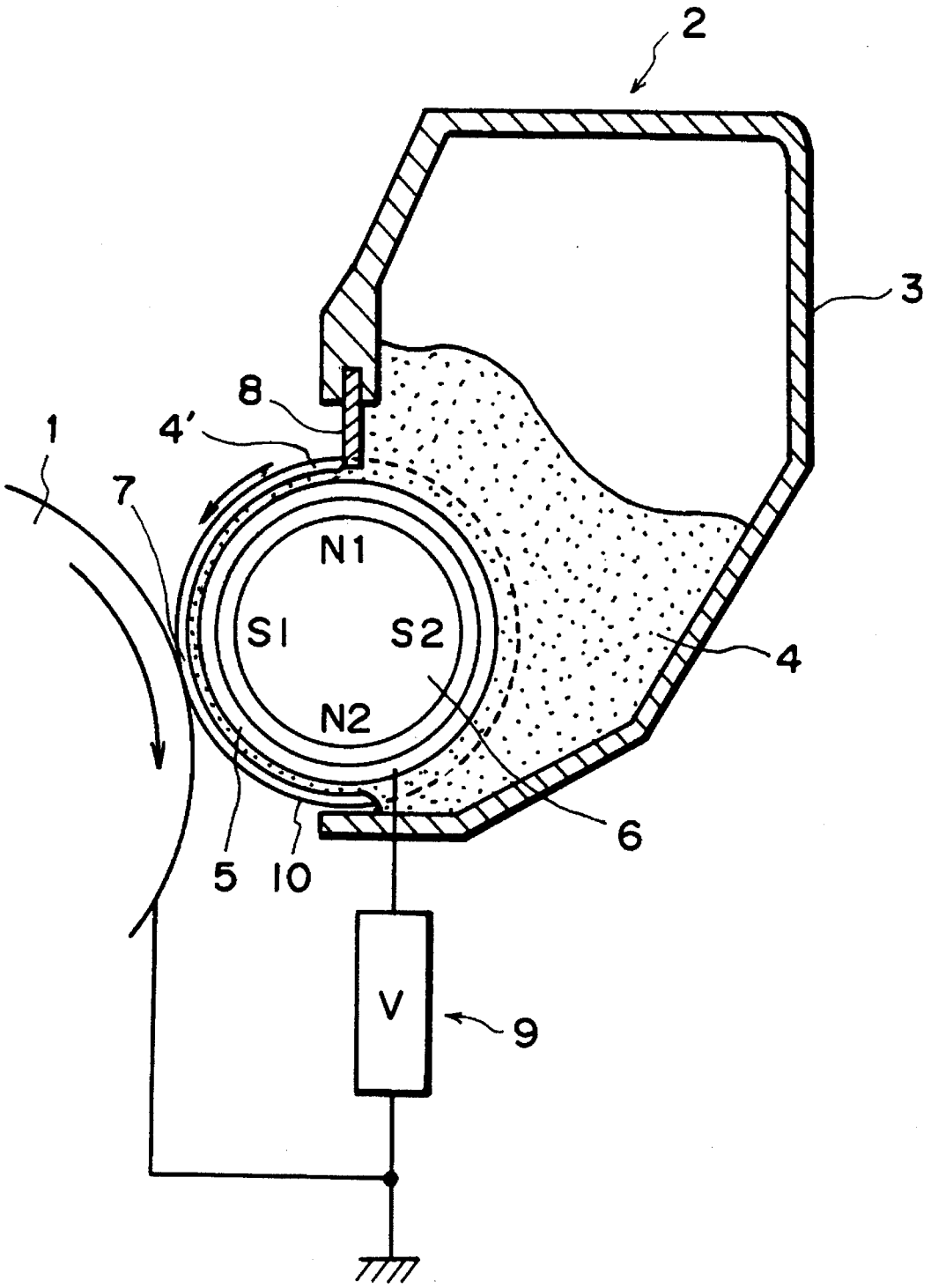
FIG. 1 is a sectional view of a preferred embodiment of the developing apparatus according to the present invention.

FIG. 1 is a sectional view of a preferred embodiment of the present invention.

In FIG. 1, an electrostatic latent image is formed on a cylindrical electro-photographic photosensitive drum 1, with the use of a known means for forming the electrostatic latent image, which comprises a charger, an exposing means, or the like. As the exposing means, a means for projecting the optical image of the original, or an optical system which scans a laser beam modulated in response to signals carrying the imaging data for the image to be recorded, or the like means, can be employed.

The latent image formed on the photosensitive member 1 is developed by the developing apparatus comprising a developing device 2 and an electric power source 9 which is the means for applying the developing bias. In other words, a toner image is formed.

In the developing device 2, the aforementioned latent image is developed by a developer containing no carrier particles, that is, a one-component dielectric developer 4. In this embodiment, developer 4 contains dielectric magnetic toner as the main ingredient, and preferably, a minute amount of micro-particles of silica. These micro-particles of silica are added to the developer in order to control the frictional charge potential of the toner, so that the image density is increased, and also, an image with a minimum amount of roughness is obtained.

The developer particles 4 stored in a container 3 are fed out from the container 3 by a cylindrical sleeve 5 made of non-magnetic material such as aluminum or stainless steel, and is delivered to a developing zone 7. In the developing zone 7, the drum 1 and the sleeve 5 face each other, a minimum gap of 50–500 μm therebetween. It is here in this developing zone where the developer is transferred onto the latent image, developing thereby the image.

The thickness of the layer 4' of a developer to be delivered to the developing zone 7 is regulated by a blade 8. The blade 8 is a member made of magnetic material such as iron, facing the magnetic pole $N_1$ of a stationary magnet 6 positioned within the sleeve, with the sleeve 5 being interposed. Therefore, the magnetic force from the magnetic pole $N_1$ converges to the blade 8, forming thereby a powerful magnetic curtain between the blade 8 and sleeve 5. This magnetic curtain forms on the sleeve 5 the one-component magnetic developer layer 4' which is thinner than the gap between the blade 8 and the sleeve 5.

Further, the gap between the blade 8 and the sleeve 5 is set up in such a manner that the thickness of the formed developer layer 4' is thinner than the minimum gap between the sleeve 5 and the drum 1.

Alternatively, the thickness of the developer layer may be regulated with an elastic blade being pressed upon the sleeve 5.

As described in the foregoing, in the apparatus shown in FIG. 1, a so-called non-contact type development process is carried out. In other words, since the thickness of the layer 4' of the developer to be conveyed into the developing zone 7 is less than the minimum gap between the sleeve 5 and the drum 1, the developer flies from the sleeve 5, across the air gap, to the drum 1.

In order to improve the development efficiency, so that a crisp, fog-free image having a high density can be developed, an oscillating bias voltage from an electric power source 9, which will be described later, is applied to the sleeve 5. This oscillating bias voltage is a voltage in which an AC voltage is superposed on a DC voltage. It is preferred for this oscillating bias voltage to be such a voltage that the values of the latent image potentials corresponding to the dark and light portions of the original fall between the maximum and minimum values of the oscillating bias voltage, and that the DC voltage value falls between the value of the latent image potential corresponding with the dark portion of the original, and the value corresponding with the light portion. The oscillating bias voltage is preferred to have a frequency of 0.6–2.7 KHz, and a peak-to-peak voltage (difference between the maximum and minimum value) of 0.4–2.0 KV. As to the waveform, a rectangular wave, a sine wave, a triangular wave, or the like, is used. With the application of such a bias voltage, the developer in the developing zone 7 is alternately affected by an electric field which urges the developer in a direction from the sleeve 5 toward drum 1, and another electric field which urges it in a direction from drum 1 toward sleeve 5, whereby the developer vigorously oscillates in the developing zone. As a result, an image of superb quality can be produced.

The value of the DC voltage component in the oscillating bias voltage is set to fall between the values of the latent image potentials corresponding to the light and dark portions of the original. In the case of a reverse development process, the DC voltage component value preferably is set closer to the latent image potential value corresponding to the dark portions than that corresponding to the light portions, and in the case of a normal developing process, it is preferably set closer to the light portions than the dark portions, in consideration of fog prevention, image density improvement, prevention of the thinning of the lines in line drawings, and the like.

Whatever the case may be, the value of the aforementioned DC voltage value is set to be a value selected to correspond to the target values for the degree of fogginess, the image density, the line width in line drawings, and the like. According to this embodiment, the aforementioned target values can be reliably reached even when the gap between the drum and the sleeve periodically changes, or even if this gap is different for each process cartridge.

Here, reverse development means a development process in which the latent image is developed or visualized by adhering developer charged to the same polarity as the latent image, to the latent image, on the portion of the image bearing member corresponding to the light portion of the original. On the contrary, a normal development process is one in which the latent image is developed or visualized by adhering developer charged to the polarity opposite to that of the latent image, to the latent image, on the portion of the image bearing member which corresponds to the dark portion of the original.

The developer is mainly charged to the polarity for developing the latent image by friction between the developer and the sleeve 5.

Further, the magnetic pole $S_1$ of the magnet 6 forms a magnetic field, which contributes to prevent fogging, so that an image defined with crisp lines can be developed. The magnetic poles $N_2$ and $S_2$ contribute to convey the developer.

Designated by a reference numeral 10 is a spacer roller provided at respective longitudinal ends of the sleeve 5, sharing the same axis as the sleeve 5. It is placed in contact with the drum 1 and maintains the gap between the sleeve 5 and drum 1.

Figure 2:
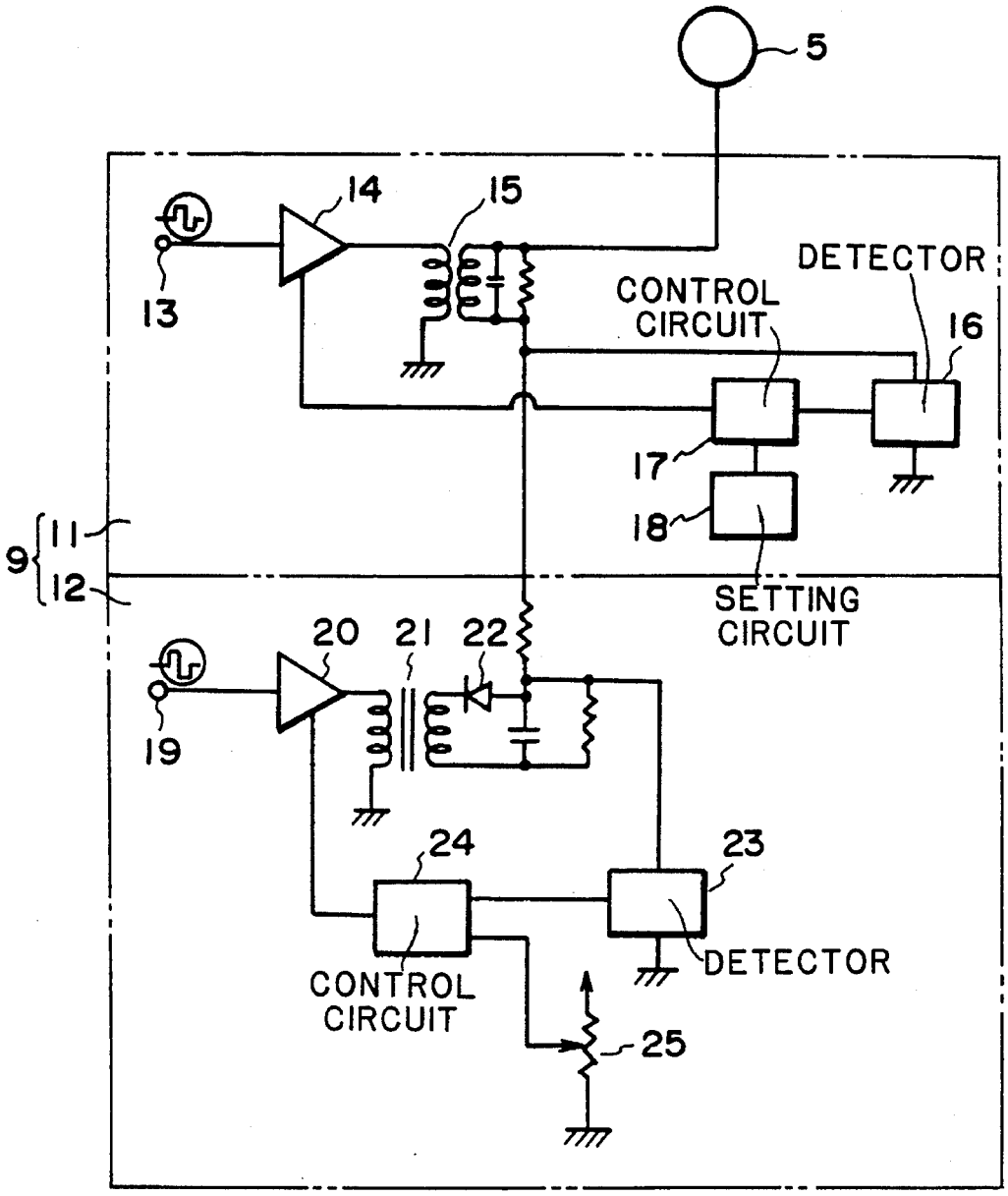
FIG. 2 is a block/circuit diagram of a means for applying a bias voltage.

FIG. 2 schematically shows an example of a power source 9 for development bias.

In FIG. 2, the power source 9 comprises a constant-current AC source 11 which provides the AC voltage component in the oscillating bias voltage, and a constant-voltage DC source 12 which provides the DC voltage component of the oscillating bias voltage.

The AC source 11 comprises: a terminal 13 for receiving an initial voltage having a frequency and a waveform, which are equivalent to the frequency and the waveform of the AC voltage component of the oscillating bias voltage to be applied to the sleeve 5; a variable amplifier for amplifying this initial voltage; and a transformer 15 for stepping up the output of the amplifier 14.

The AC source 11 further comprises: an AC detector 16 for detecting the current value of the AC voltage output, that is, the current value of the alternating current (effective value); and a control circuit 17 which compares the current value of the alternating current detected by this detector 16, to a reference current value of the alternating current set by a setting circuit 18.

The control circuit 17 controls the gain of the variable amplifier 14 so that the difference between the current value of the alternating current detected by the detector 16 and the reference current value for the alternating current becomes zero. In other words, the output of the variable amplifier 14 is controlled so that the current value (effective value) of the AC output of the power source 11 remains constant.

On the other hand, the constant voltage power source 12 comprises: a terminal 19 for receiving an initial voltage as the input for generating a DC voltage, having a rectangular waveform and a frequency of, for example, 20 KHz a variable amplifier 20 for amplifying this initial voltage; a transformer 21 for stepping up the output of the transformer 20; and a rectifier 22 for converting, by rectification, the AC voltage output of the transformer 21 into a DC voltage output.

The constant voltage power source 12 further comprises: a DC voltage detector 23 for detecting the voltage value of the DC voltage output; and a control circuit 24 for comparing the voltage value detected by the detector 23 to a reference voltage value set by a setting circuit 25.

The control circuit 24 controls the gain of the variable amplifier 20 so that the difference between the DC voltage value detected by the detector 23 and the reference value for the DC voltage converges to zero. In other words, the output of the variable amplifier 20 is controlled so that the voltage value of the DC output of the power source 12 remains constant.

Thus, an oscillating bias voltage, in which the constant-current AC voltage generated by the constant-current AC power source 11, and the constant-voltage DC voltage generated by the constant-voltage DC power source 12, are superposed, is applied to the developing sleeve 5, whereby the oscillating electric field is generated in the developing zone 7.

For example, when an electrostatic latent image having a dark portion potential (surface potential on the portion not exposed to the light) of −700 V, and a light portion potential (surface potential on the portions exposed to the most intensive light reflecting the light portion of the image on the original) of −100 V is developed by a reverse development process by toner charged to a the negative polarity by friction, an image with excellent quality can be developed by the following oscillating bias voltage:

| | |
|---|---|
| Alternating current | 1.96 mA (rectangular wave) |
| Frequency | 1.8 KHz |
| Direct current | −500 V |

wherein the peak-to-peak value of the oscillating bias voltage at this time is approximately 1600 V.

The sleeve 5 used in this embodiment was made of, for example, aluminum, wherein the aluminum material was shaped 16 ϕ and sand-blasted with MOLUNDUM A #400 (alundum abrasive grains), a product of Showa Denko K. K., and its center line average height Ra defined according to JIS B-0601 was approximately 0.5 μm.

The designed value for the minimum gap between the sleeve 5 and drum 1 (hereinafter, called SD gap) was 300 μm. However, as the sleeve and drum rotate, the SD gap periodically changes due to the production tolerance difference in the thickness of the spacer roller 10, or the like, by approximately ±10 μm from a mean value of 300 μm. However, since the AC voltage component of the oscillating bias voltage is generated by the constant-current AC power source 11, the strength of the oscillating electric field in the developing zone 7 is kept substantially constant even when the SD gap changes as described above. As a result, the magnitude of the developer oscillation in the developing zone is kept constant; therefore, even when the SD gap changes, an image in accordance with the target values for the image density, gradation, degree of fogginess, line width of line drawings, and the like, which are set by the setting circuit 25, can be obtained.

In the case of the embodiment shown in FIG. 1, the setting circuit 25 of the constant-voltage DC power source 12 further comprises a variable resistor which an operator can adjust. The operator can adjust the variable resistor to change the aforementioned reference voltage value, that is, to select desirable target values. Thus, according to this embodiment, even when the SD gap changes, a developed image in accordance with the preferred values set by the operator can be obtained.

Whichever the case may be, the DC voltage output from the constant-voltage DC power source 12, that is, the DC voltage component of the oscillating bias voltage is controlled to maintain a constant voltage; therefore, the aforementioned target values themselves, which are set by this DC voltage component, are not going to be affected even when the SD gap changes as stated above. Further, the magnitude of the developer activity stimulated by the AC voltage component is kept stable regardless of the changes in the SD gap; therefore, an image in accordance with the set target values can be produced.

Next, the difference in the density of the developed image between when the AC voltage was constant-voltage controlled (effective value) as in the prior method, and when the AC voltage was constant-current controlled as in this embodiment, is numerically presented in Table 1. The density was measured by a MacBeth reflection densitometer and the parameter is the SD gap.

Referring to Tables 1 and 2, in the case of a comparative test 1, an oscillating bias voltage, in which a DC voltage of −500 V was superposed on an AC voltage having a peak-to-peak voltage of 1600 V (constant-voltage controlled), and which had a rectangular waveform, was applied to the developing sleeve, and in the case of this embodiment, an oscillating bias voltage (peak-to-peak value was more or less 1600 V), in which a constant-voltage controlled DC voltage of −500 V was superposed on an AC voltage, the AC value (effective value) of which was constant-current controlled to converge to 1.96 mA, and the frequency of which was 1.8 KHz, was applied to the developing sleeve. In both cases, the images were developed through a reverse development process.

TABLE 1

| SD gap (μm) | Comp. Ex. 1 Density | Ex. 1 Density |
|---|---|---|
| 250 | 1.26 | 1.14 |
| 300 | 1.18 | 1.18 |
| 350 | 0.92 | 0.98 |

As shown in Table 1, the application of the constant-current controlled oscillating bias voltage could make smaller the magnitude of the image density changes related to the changes in the SD gap; therefore, the changes in the line width of line drawings could be made smaller.

Further, Table 1 gives the results of tests in which images were developed using a one-component developer composed of a toner, the volume average particle diameter of which was 12 μm, which was measured by a Coulter counter made by Coulter Co.

Recently, in order to create an image with higher resolution, a toner having a much smaller volume average particle diameter has been tried, wherein when a toner having a volume average particle size of less than 9 μm was employed in this embodiment, outstanding effects were recognized.

Table 2 gives the results of tests in which a one-component developer composed of a toner having a volume average particle diameter of 9 μm was employed.

TABLE 2

| SD gap (μm) | Comp. Ex. 2 Density | Ex. 2 Density |
|---|---|---|
| 250 | 1.38 | 1.36 |
| 300 | 1.36 | 1.36 |

TABLE 2-continued

| SD gap (μm) | Comp. Ex. 2 Density | Ex. 2 Density |
|---|---|---|
| 350 | 1.24 | 1.36 |

As shown in Table 2, according to the present invention, when the one-component developer composed of the toner having a volume average particle diameter of 9 μm was used, the image density remained substantially constant even when there were changes in the SD gap. The same effects could be confirmed up to a point where the volume average particle diameter was reduced from 9 μm to 5 μm. In conclusion, according to the present invention, when a one-component developer having a volume average particle diameter which is less than 9 μm but no less than 5 μm is used, substantial image density changes do not occur even when there are changes in the SD gap; therefore, substantial line width changes in line drawings do not occur.

Figure 3:
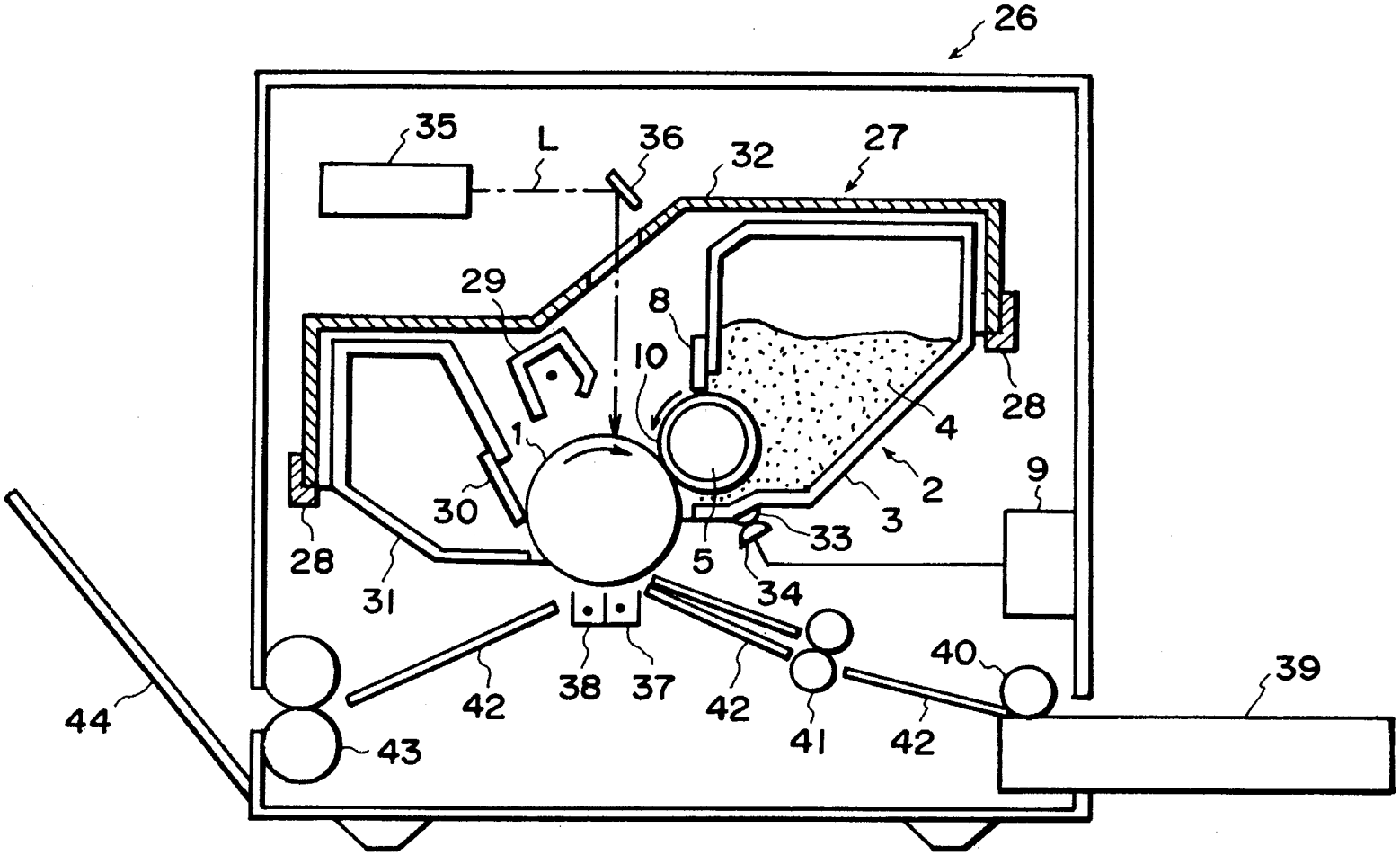
FIG. 3 is a sectional view of an embodiment of the image forming apparatus according to the present invention.

FIG. 3 depicts an image forming apparatus to which the present invention is applicable.

In FIG. 3, a main assembly 26 of the image forming apparatus comprises: an optical device, which will be described later, a transfer material conveying device, a transfer device, a fixing device, the power source 9 described in the foregoing, and a guide member 28 which guides a process cartridge 27 as it is installed into, or removed from, the main assembly 26.

The process cartridge 27 comprises: an electro-photographically sensitive drum member 1 which rotates in the direction indicated by an arrow; a charger 29 for charging uniformly the photosensitive member 1; the previously described developing device for developing an electrostatic latent image formed on the photosensitive member 1; and a cleaning device container 31 containing a cleaning blade 30 for removing residual toner on the surface of the photosensitive member 1 after the developed image is transferred. These various means are integrally supported in a molded synthetic resin frame 32. The process cartridge 27 is slid in or out of the main assembly, following the guide member 28. After the toner in the developing device 2 is completely consumed, the process cartridge 27 is taken out of the main assembly 26 by the operator, and another process cartridge 27 with a developing device 2 filled in advance with toner is installed into the main assembly 26.

On one of the exterior surfaces of the process cartridge 27, an electric contact 33 is provided for delivering the developing bias voltage to the sleeve 5. As the process cartridge 27 is installed in the main assembly 26, this electric contact 33 is connected to the output contact 34 of the previously described power source 9, whereby it becomes possible for an oscillating bias voltage to be delivered from the power source 9 to the sleeve 5.

Next, an image forming operation will be described. The photosensitive member 1 is first charged by the charger 29, and then, is exposed to a scanning laser beam L modulated in response to signals carrying imaging data of an image to be recorded, whereby an electrostatic latent image is formed on image bearing member 1. The laser beam L is emitted from a known optical apparatus 35 (e.g.,) comprising a semiconductor laser, a rotary polygon mirror, f-θ lens, and the like, not shown) and is reflected toward the photosensitive member 1 by a mirror 36.

The electrostatic latent image is reverse developed by the developing device 2 to which the bias voltage comprising the constant-current controlled AC component is applied. The toner image thus obtained is transferred onto transfer material such as paper by a transfer charger 37, and then, the transfer material is separated from the photosensitive member 1 by a charge removing, separating device 38.

The device for conveying the transfer material comprises: a cassette 39 for storing the transfer material, a pickup roller for feeding out the transfer material from the cassette 39, a registration roller 41 for delivering the transfer material to the transferring zone in synchronization with the toner image movement, and a conveyer guide 42.

The transfer material separated from the photosensitive member 1 is delivered, via guide 42, to a fixing device 43, where the toner image is fixed to the transfer material. After the fixing operation, the transfer material is discharged onto a tray 44.

The cartridge described in the foregoing is of a type comprising a cleaning device 30, and a charger 29, in addition to the drum-shaped electro-photographically sensitive member 1 and developing device 2. However, the present invention is also applicable to a different type of process cartridge comprising the photosensitive member and developing device, but no cleaning device or charger.

The process cartridges as described in the foregoing, the periodical changes in the SD gap may occur due to eccentricities of the drum, sleeve, spacer roller, or the like, and in addition, the SD gap may be slightly different from one cartridge to the next due to differences between various production lines or the like.

However, according to the present invention, even when periodic changes occurs to the SD gap, and also, even when there is a slight difference in the SD gap between the empty cartridge and the replacement cartridge, a superb image can be always obtained, which is free of density inconsistency and density differences.

Further, the present invention can be applied to a developing device employing a one-component magnetic developer, a developing device employing a bi-component developer comprising toner and magnetic carrier particles, and also, a developing device employing a normal developing process.

Further, the present invention is applicable not only to a non-contact type developing device, but also, to a developing device in which the developer layer is thicker than the SD gap in the developing zone, that is, a contact type developing device in which the image bearing member is rubbed by the developer layer.

Further, the present invention can be applied to a developing device in which an oscillating bias voltage to be applied is such that the maximum, and/or the minimum value, of the oscillating bias voltage fall between the potential value of the electrostatic latent image, at a portion in correspondence with the dark portion of the image on the original, and that at the portion in correspondence with the light portion.

While the invention has been described with reference to the embodiments of the present invention, it is not confined to the details set forth and this application is intended to cover such modifications or changes as may come within the purpose of the improvements of the scope of the following claims.

What is claimed is:

1. A developing apparatus comprising:

an image bearing member for bearing an electrostatic image;

a developer carrying member, opposed to said image bearing member to form a developing zone therebetween, for carrying a developer to the developing zone to develop an electrostatic latent image on said image bearing member; and oscillating bias means for applying an oscillating bias to said developer carrying member;

wherein said oscillating bias comprises a constant-current-controlled AC component and a constant-voltage-controlled DC component.

2. A developing apparatus according to claim 1, wherein said developer carrying member is opposed to said image bearing member to form a predetermined gap therebetween.

3. A developing apparatus according to claim 2, wherein said developer carrying member is a rotatable roller having an axis, and said image bearing member is a rotatable drum having an axis, and wherein said developing apparatus further comprises a space maintaining member that is coaxial with the axis of said rotatable roller, and is pressed against said rotatable drum for maintaining said predetermined gap between said rotatable roller and said rotatable drum.

4. A developing apparatus according to claim 2 or 3, further comprises a regulating member for regulating a thickness of a layer of developer conveyed to the developing zone by said developer carrying member.

5. A developing apparatus according to claim 4, wherein said developer is a one-component developer.

6. A developing apparatus according to claim 5, wherein a volume average particle diameter of said one-component developer is 5–9 μm.

7. A developing apparatus according to claim 4, wherein said regulating member regulates said developer so that the thickness of the layer of developer is less than said predetermined gap.

8. A developing apparatus according to claim 6, wherein said regulating member regulates said developer so that the thickness of the layer of developer is less than said predetermined gap.

9. An image forming apparatus comprising:

a supporting member for detachably supporting a process cartridge comprising an image bearing member for bearing an electrostatic image, and a developing device, including a developer carrying member opposed to said image bearing member to form a developing zone therebetween, for carrying a developer to the developing zone to develop an electrostatic latent image formed on said image bearing member;

oscillating bias means for applying an oscillating bias to said developer carrying member;

wherein said oscillating bias comprises a constant-current-controlled AC component and a constant-voltage-controlled DC component.

10. An image forming apparatus according to claim 9, wherein said developing device includes a regulating member for regulating a thickness of a layer of developer carried to the developing zone on said developer carrying member, and said regulating member regulates said developer so that the thickness of the layer of developer carried to the developing zone is less than said predetermined gap.

11. An image forming apparatus according to claim 9 or 10, wherein said developer is a one-component developer.

12. An image forming apparatus according to claim 11, wherein a volume average particle diameter of said one-component developer is 5–9 μm.

13. An image forming apparatus according to claim 9 or 10, wherein said image bearing member is a rotatable drum having an axis, and said developer carrying member is a rotatable roller having an axis, and wherein said developing apparatus further comprises a space maintaining member coaxial with said rotatable roller, and is pressed against said rotatable drum for maintaining said predetermined gap between said rotatable roller and said rotatable drum.

14. An image forming apparatus according to claim 13, wherein said developer is a one-component developer.

15. An image forming apparatus according to claim 14, wherein a volume average particles diameter of said one-component developer is 5–9 μm.

* * * * *

UNITED STATES PATENT AND TRADEMARK OFFICE

CERTIFICATE OF CORRECTION

PATENT NO. : 5,519,471 Page 1 of 2

DATED : May 21, 1996

INVENTOR(S) : Katsuhiko NISHIMURA, et al.

It is certified that error appears in the above-indentified patent and that said Letters Patent is hereby corrected as shown below:

On title page,

IN THE TITLE [54]:

Line 3, "CONSTANT-VOLTAGE-DC" should read --CONSTANT-VOLTAGE DC--.

COLUMN 1:

Line 3, "CONSTANT-VOLTAGE-DC" should read --CONSTANT-VOLTAGE DC--.

COLUMN 2:

Line 63, "is" should read --are--; and
Line 64, "other, a" should read --other, maintaining a--.

COLUMN 4:

Line 62, "20 KHz" should read --20 KHz;--.

COLUMN 7:

Line 61, "(e.g.,)" should read --(e.g.,--.

UNITED STATES PATENT AND TRADEMARK OFFICE

CERTIFICATE OF CORRECTION

PATENT NO. : 5,519,471 Page 2 of 2

DATED : May 21, 1996

INVENTOR(S) : Katsuhiko NISHIMURA, et al.

It is certified that error appears in the above-indentified patent and that said Letters Patent is hereby corrected as shown below:

COLUMN 9:

Line 21, "comprises" should read --comprising--.

COLUMN 10:

Line 5, "member;" should read --member; and--;
Line 30, "apparatus" should read --device--; and
Line 37, "particles" should read --particle--.

Signed and Sealed this

Fifth Day of November, 1996

Bruce Lehman

*Attest:*

BRUCE LEHMAN

*Attesting Officer*

*Commissioner of Patents and Trademarks*